United States Patent [19]

Werft

[11] Patent Number: 4,565,372

[45] Date of Patent: Jan. 21, 1986

[54] PERSONAL DEFENSE DEVICE

[75] Inventor: August R. Werft, Venice, Fla.

[73] Assignee: Allan J. Werft, Chagrin Falls, Ohio ; a part interest

[21] Appl. No.: 631,450

[22] Filed: Aug. 31, 1984

Related U.S. Application Data

[63] Continuation-in-part of Ser. No. 457,758, Jan. 13, 1983, Pat. No. 4,489,943.

[51] Int. Cl.[4] ..... F41B 15/06
[52] U.S. Cl. ..... 273/84 R
[58] Field of Search ..... 273/84 R; 131/253, 254, 131/255

[56] References Cited

U.S. PATENT DOCUMENTS

| | | | |
|---|---|---|---|
| 802,264 | 10/1905 | Brown | 294/19.2 |
| 1,504,652 | 8/1924 | Sweet | 131/254 |
| 1,755,646 | 4/1930 | Halstead | 43/5 |
| 2,843,135 | 7/1958 | Lisiewski | 131/255 |
| 3,763,872 | 10/1973 | Gooley | 135/66 |
| 4,489,943 | 12/1984 | Werft | 273/84 R |

FOREIGN PATENT DOCUMENTS

| | | | |
|---|---|---|---|
| 559747 | 3/1944 | United Kingdom | 273/84 R |
| 1187979 | 4/1970 | United Kingdom | 273/84 R |

*Primary Examiner*—William H. Grieb
*Attorney, Agent, or Firm*—Hauke and Patalidis

[57] ABSTRACT

A hand held device for personal defense provided with a piercing member mounted on the end of a handle. The piercing member is normally sheathed by a tubular protective sheathing housing reciprocable against spring bias from a finite position shielding the piercing member to a position wherein at least the tip of the piercing member projects beyond the tubular housing, such that by a straight stabbing action of the handle, the end of the tubular housing engaging the flesh of an assailant causes the tubular housing to retract such as to expose the end of the piercing member for causing wounds to be inflicted upon the assailant. The piercing member may be in the form of a straight prong permanently attached to the end of the handle, in the form of a double-prong barbed member, or a combination of both, the double-prong barbed member being resiliently and frictionally held in a bore on the end of the handle normally surrounded by the tubular protective sheathing housing.

32 Claims, 8 Drawing Figures

PERSONAL DEFENSE DEVICE

CROSS-REFERENCE TO RELATED APPLICATION

The present application is a continuation-in-part of application Ser. No. 457,758 for "Personal Protection Device", filed Jan. 13, 1983, now U.S. Pat. No. 4,489,943, issued Dec. 25, 1984.

BACKGROUND OF THE INVENTION

The present invention relates in general to hand-held devices for personal protection or defense. More particularly, the invention relates to a lightweight hand-held defense device allowing the user to repel an assailant by inflicting non-lethal wounds.

Rapes, muggings, purse snatchings and other physical assaults are a serious problem in the present society. These assaults often result in bodily harm, mental anguish and loss of property. Each known method of personal protection has certain disadvantages. Firearms and knives, for example, cannot be carried upon the person of most citizens without violation of Federal and State statutes. Even those citizens who are permitted to carry such dangerous weapons may not wish to inflict as massive or lethal an injury to another as is typical through the use of such weapons. In addition, such weapons have been shown to carry a substantial risk of injury to the owner through accidental discharge or impalement.

Commercially sold gas cannisters, contemplated for spraying into the face of an attacker, for example, have also been shown to be ineffective for their intended purpose. In reality, such cannisters are difficult to aim accurately, particularly where the victim is taken by surprise. The deterrent effect of the spray in such cannisters, even if actually administered to an assailant in a strong dose, has also been questioned. Moreover, these sprays are especially susceptible to weakening if sprayed any substantial distance through the ambient.

Knowledge of defense techniques, such as karate and judo, is also an unacceptable alternative for many persons. Some persons simply lack the physical strength necessary to employ such techniques effectively, or lack the self-discipline required to master such techniques in the first instance.

What is needed therefore is a new personal protection device which is easy to operate, effective in its intended purpose of deterring attack, and which is inexpensive to manufacture.

The invention disclosed in prior application Ser. No. 457,758 accomplishes its objects by providing a lightweight, hand-held personal protective device which deters an attacker by means of a hook member, three-pronged fishing hook for example, mounted on the end of a reciprocable rod, preferably in a break-away fashion. The hook is normally retracted in a protective housing and controllably extended from the open end of the housing. The aforesaid application requires that the user swing with the device at his or her assailant, in such manner as to hook the assailant. Such motion presents some inconveniences to the user as he or she must aim at some exposed portion of the body of the assailant in order to use the device in an effective manner, and the hook member may be caught by the assailant's clothing rather than becoming embedded in his flesh or skin.

SUMMARY OF THE INVENTION

The present invention provides a personal defense device provided with one or more straight prongs or hooks mounted on the end of a handle and enclosed in a reciprocable protective housing. Upon impact with the body of a person, by pushing the housing-provided end of the handle in a straight stabbing motion, the housing retracts against a spring bias such as to expose the prongs or hooks projecting through the end of the housing.

The invention provides a personal defense device which is small in size, light in weight, which has retracted prongs or hooks which extend only upon impact on a solid or resilient surface, wherein the prongs or hooks are continuously sheathed and become uncovered only when the device is pressed against a surface. The personal defense device of the invention is easy to manufacture, is safe in use and can be manufactured at low cost.

The many objects and advantages of the present invention will become apparent to those skilled in the art when the following description of examples of the best mode contemplated for practicing the invention is read in conjunction with the accompanying drawing, wherein like numerals refer to like or equivalent parts, and in which:

DETAILED DESCRIPTION OF THE PREFERRED EMBODIMENT

Figure 1:
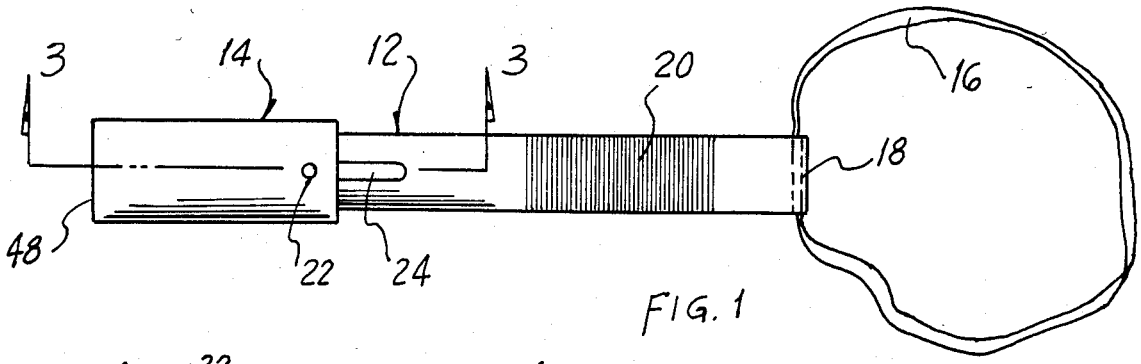
FIG. 1 is an elevation view of an example of structure for a personal defense device according to the present invention.
Figure 2:
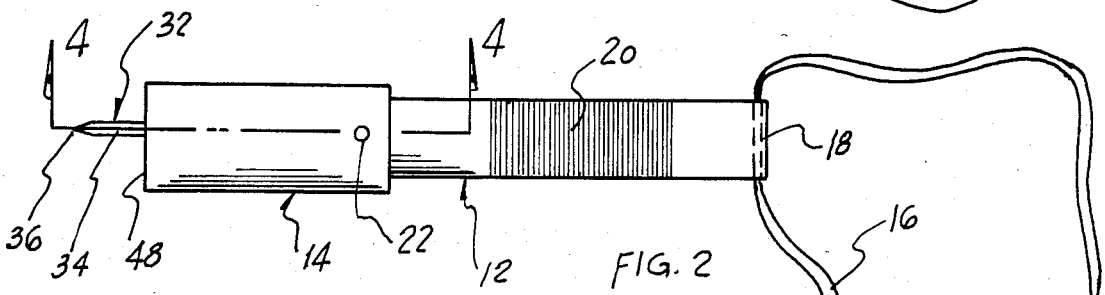
FIG. 2 is a view similar to FIG. 1, but showing the device with a prong extended from one end thereof.

Referring to the drawing, and more particularly to FIGS. 1 and 2 thereof, there is illustrated an example of structure for a personal defense device according to the present invention and comprising a handle 12, in the form of a plastic or metallic rod provided on one end with a plastic or metallic tubular housing 14. The other end of the handle 12 is provided with a flexible strap 16 made of any convenient flexible material such as leather or of elastic material such as an elastic band or the like, forming a loop which is passed through a transverse bore 18 at the end of the handle 12. The surface of the handle 12 is preferably knurled or provided with a plurality of contiguous shallow grooves, as shown at 20, such as to form a non-slippery grip. The tubular housing 14 is held, within a state of limited range, reciprocable over the other end of the handle 12 by means of a transverse pin 22, FIGS. 1–5 extending diametrically through the tubular housing 14 and through an aligned substantially centrally disposed longitudinal slot 24 formed in the handle 12.

Figure 3:
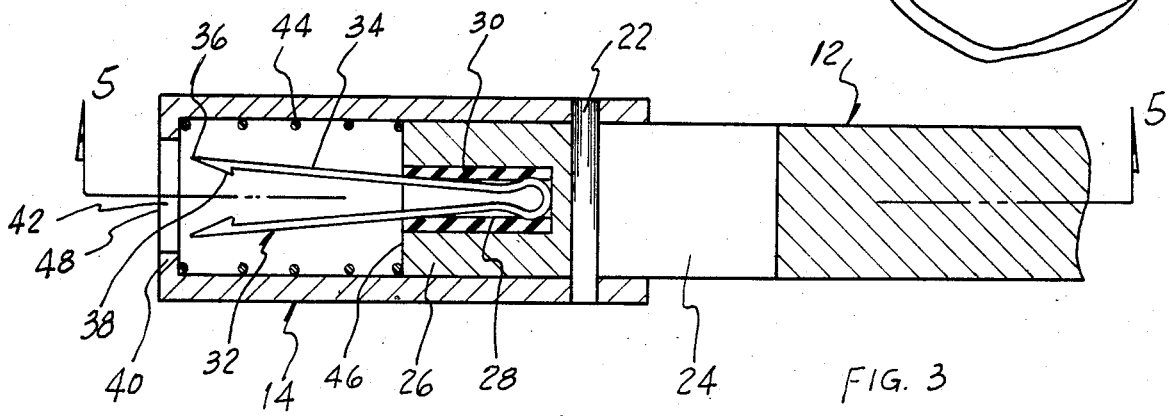
FIG. 3 is a longitudinal sectional view thereof along line 3—3 of FIG. 1.
Figure 4:
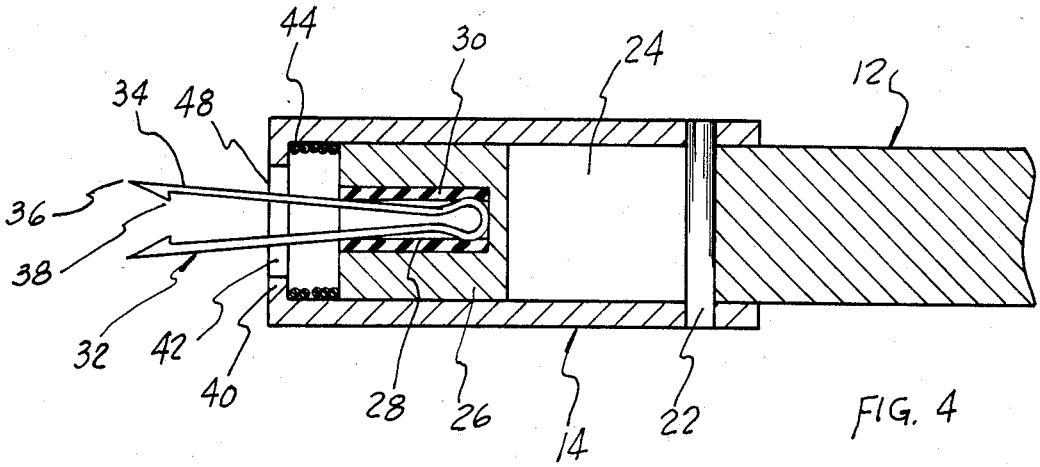
FIG. 4 is a partial longitudinal section thereof along line 4—4 of FIG. 2.
Figure 5:
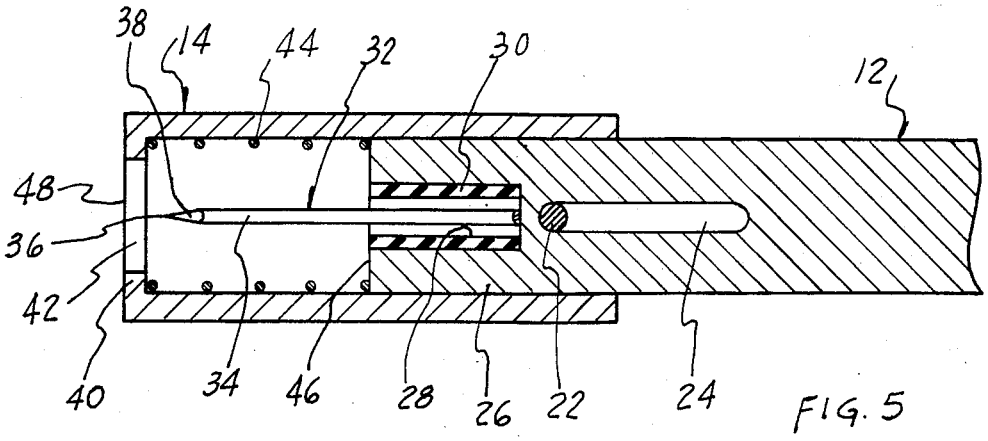
FIG. 5 is a partial longitudinal section thereof along line 5—5 of FIG. 3.

As best shown at FIG. 3, the end portion 26 of the handle 12 projecting within the tubular housing 14 beyond the longitudinal slot 24 has a centrally disposed bore 28 in which is frictionally installed a resilient sleeve 30, made of elastomeric plastic material for example, which frictionally retains within the bore 28 a double-prong hook member 32. The double-prong hook member is made, for example, of spring steel, and comprises a pair of shanks 34 made in a single piece and bent over as shown such as to dispose the shanks 34 at a very sharp angle substantially in a single plane. Each of the shanks 34 terminates in a sharp point 36 having an inwardly directed barb 38. The extreme end of the tubular housing 14 forms a flange 40, radially and inwardly directed, defining a central opening 42 of a diameter slightly larger than the distance separating the two points 36 of the double-prong hook member 32. A coil spring 44 is disposed between the housing end flange 40 and the end face 46 of the handle end portion 26.

The coil spring 44 normally urges the reciprocable protective housing 14 to the position shown at FIGS. 1 and 3, the transverse diametrical pin 22 bottoming against the left end, as shown in the drawing, of the slot 24 in the handle 12, thus completely sheathing and shielding the double-prong hook member 32 which is completely retracted within its protective sheathing housing 14. The end flange 40 of the reciprocable protective sheathing housing 14 defines an annular outer abutment surface 48 which, upon being applied against a body surface such as the skin of an assailant, as a result of a straight stabbing motion manually imposed upon the handle 12, causes the reciprocable protective sheathing housing 14 to be displaced to the right, as seen in the drawing, against the compression force exerted by the coil spring 44, thus causing the double-prong hook member to project through the aperture 42 at the end of the housing 14, FIGS. 2 and 4, with the result that the exposed sharp points 36 of the double-prong hook member 32 perforates the skin of the person and penetrates into his flesh. A motion of the handle 12 in an opposite direction frees the double-prong hook member 32 which is separable from the end portion 26 of the handle 12 under a small pull, as a result of being only frictionally and elastically held within the resilient elastic sleeve 30 within the central bore 28. The barbs 38 of the double-prong hook member 34 cause it to remain solidly embedded in the skin and flesh of the assailant, such that the assailant may require light surgery in order to remove the double-prong hook member 32 from his flesh, which may be of considerable aid in his ulterior apprehension.

Preferably, the double-prong hook member 32 is anodized in a specific color, or marked in some other manner, such as to provide an easy identification of its origin. It is to be noted that, furthermore, in view of the special characteristic shape of the double-prong hook member 32, with the points 36 provided with oppositely facing barbs 38, that is quite different from articles usually found on the market, such as fishhooks, a further means of identification of the origin thereof is achieved.

Figure 6:
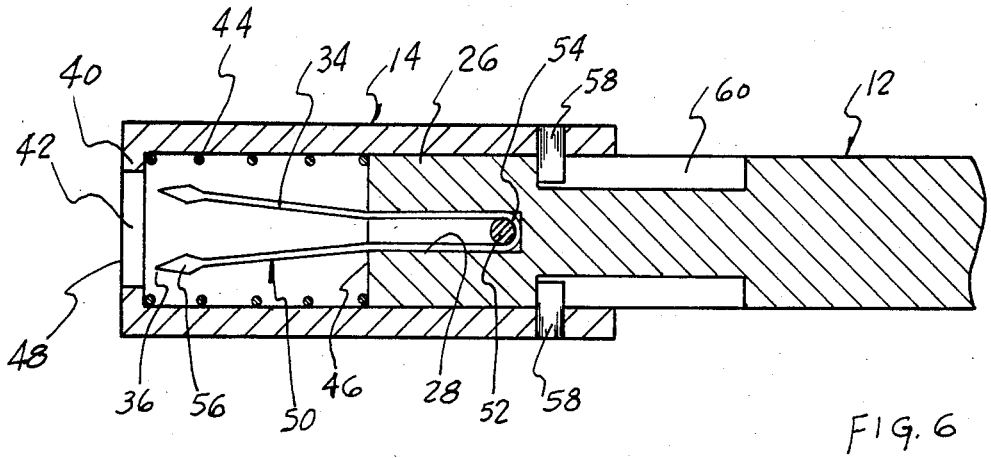
FIG. 6 is a view similar to FIG. 3 but illustrating a modification thereof.

FIG. 6 illustrates a modification of the invention provided with a non-removable double-prong member 50 permanently held, such as by cementing or by means of a transverse pin 52 through the end portion 26 of the handle 12. The shanks 34 are formed integral and are U-shaped at their connecting end, as shown at 54, which is engaged proximate the bottom of the blind bore 28 in the end portion 26 of the handle 12, and retained by the pin 52 passed transversely between the two shanks 34. The end of each shank 34 projecting from the bore 28 is provided with a sharp point 36 and with a barb as the barb 38 of FIGS. 3–5, or preferably and such as to prevent excessive tearing of the wound, with a slightly enlarged portion or bulge 56 proximate the point 36. The bulges 56 may cause a slight enlargement of the wound without excessive tearing off of tissues.

The reciprocable protective sheathing housing 14, in the structure of FIG. 6, may be held over the end portion 26 of the handle 12 by a diametrical retaining pin, as previously illustrated and explained or, in the alternative and as illustrated at FIG. 6, by a pair of radial pins 58 projecting within corresponding longitudinal grooves 60 formed on the peripheral surface of the handle 12.

In the structure of FIG. 6, a straight stabbing motion causes the protective sheathing housing 12 to retract against the pressure of the spring 44 upon impacting of the abutment annular face 48 of the housing flange 40 against the body of a person, thus uncovering the double-prong piercing member 50 with its sharp points 36 projecting beyond the opening 42 in the housing 14 Upon pulling back of the handle 12, the double-prong piercing member 50 remains attached within the bore 28 in the end portion 26 of the handle 12, such that consecutive stabbing motions cause a plurality of flesh wounds to be inflicted upon an assailant.

Figure 7:
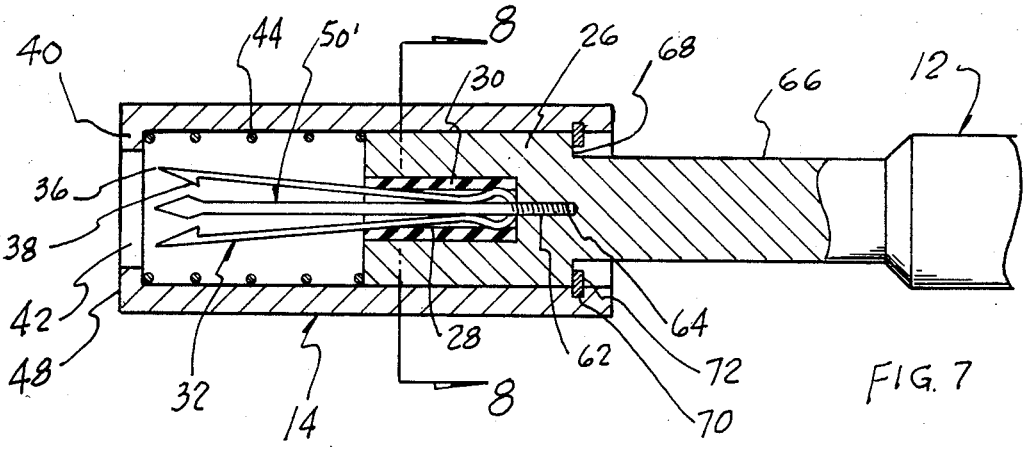
FIG. 7 is a view similar to FIG. 6 but illustrating a further modification thereof.
Figure 8:
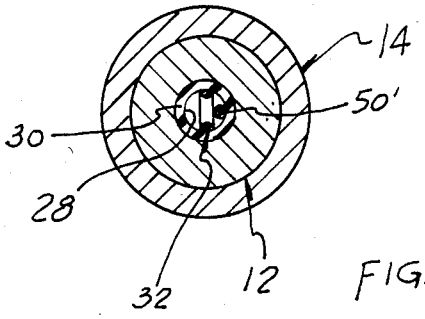
FIG. 8 is a section along line 8—8 of FIG. 7.

Referring now to FIGS. 7–8, there is illustrated a modification of the invention which may be provided with a double-prong member, or with a single-prong piercing or piercing member 50′, as shown. The single-prong piercing member 50′ is fixedly mounted projecting from the end portion 26 of the handle 12 disposed within the reciprocable protective sheathing housing 14. The shank end of the piercing prong 50′ is held by being cemented or otherwise fastened at the bottom of the blind bore 28 in the handle end 26 such as, for example, by being provided with a peripheral thread 62 engaged in the corresponding inner thread formed in a reduced diameter axial bore 64. A double-prong hook member 32 is removably mounted within the bore 28 by being frictionally and resiliently held within a resilient sleeve 30.

The structure shown at FIG. 7 also illustrates a modified arrangement for holding the reciprocable protective sheathing housing 14 over the end portion 26 of the handle 12. For that purpose, in the example of structure illustrated, the handle 12 is provided with a reduced diameter portion 66 defining an annular abutment 68 on the rear face of the handle end portion 26. The reciprocable protective sheathing housing 14 is provided at its end with an internal groove 70 in which is disposed an annular retainer in the form of a split spring ring 72, such as to prevent the end portion 26 of the handle 12 from escaping from the open end of the housing 14 under the action of the coil spring 44.

The structure of FIGS. 7–8 combines the features of the structures of FIGS. 1–5 and the features of the structure of FIG. 6 in a single embodiment, the double-prong barbed hook member 32 becoming detached upon pulling of the handle 12 away from an assailant's body, while the piercing prong 50′, remaining attached to the end portion 26 of the handle 12, permits repeated wounds to be inflicted upon an assailant.

Preferably, the reciprocable protective sheathing housing 14 and the handle 12 are made of plastic material, although it will be appreciated by those skilled in the art that they can be metallic, preferably made of a light metal such as aluminum. It will be further appreciated by those skilled in the art that although double-prong members 32 and 50 have been illustrated and described, they may be replaced by triple- or quadruple-, or more, prong members, detachable upon a slight pull being exerted, generally the automatic pull exerted upon the handle 12 during expansion of the coil spring 44 being sufficient for that purpose, and that the stationary double-prong piercing member 50 and single-prong piercing member 50' are also only examples of appropriate structures and may be replaced by multi-prong members.

Having thus described the present invention by way of typical examples of structure given for illustrative purpose only, modifications whereof will be apparent to those skilled in the art, what is claimed as new is as follows:

I claim:

1. A hand held non-lethal personal defense device comprising an elongated handle, a piercing prong member projecting from one end of said handle, a tubular housing slidably disposed over said end of said handle and displaceable from a first position sheathing said piercing member to a second position wherein said piercing member projects from the end of said tubular housing, spring bias means urging said tubular housing to said first position, and means retaining said tubular housing slidably over said handle end, wherein said piercing member has a barb such as to remain attached to a soft material in which said piercing member is inserted and to detach itself from said material upon pulling said handle.

2. The device of claim 1 wherein said piercing member is frictionally held on the end of said handle.

3. The device of claim 2 further comprising a strap attached to the other end of said handle.

4. The device of claim 1 further comprising a strap attached to the other end of said handle.

5. The device of claim 1 wherein said means retaining said tubular housing slidably over said handle end comprises a diametrically disposed pin through the wall of said housing, said pin extending through a transverse slot axially disposed in said handle.

6. The device of claim 5 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

7. The device of claim 1 wherein said means for retaining said tubular housing slidably over said handle end comprises a pair of radially disposed pins projecting internally of said tubular housing into longitudinal grooves formed peripherally in said handle.

8. The device of claim 7 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

9. The device of claim 1 wherein said means for retaining said tubular housing slidably over said handle end comprises a reduced diameter portion on said handle proximate said end, an internal annular groove formed in said tubular housing proximate the other end thereof, and a retainer spring ring disposed in said annular groove.

10. The device of claim 9 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

11. The device of claim 1 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

12. The device of claim 1 wherein said piercing member comprises at least two sharp points each provided with a barb, each point being on the end of a shank, the shanks being formed integral and bent over such as to form a stem installed in a bore formed in said handle end, an elastomeric sleeve being disposed in said bore such as to elastically and resiliently hold said stem in said bore.

13. The device of claim 1 further comprising at least one piercing member fixedly attached to said handle end.

14. A hand held non-lethal personal defense device comprising an elongated handle, a piercing prong member projecting from one end of said handle, a tubular housing slidably disposed over said end of said handle and displaceable from a first position sheathing said piercing member to a second position wherein said piercing member projects from the end of said tubular housing, spring bias means urging said tubular housing to said first position, and means retaining said tubular housing slidably over said handle end, wherein said piercing member comprises at least two sharp points each provided with a barb, each of said points being on the end of a shank, the shanks being formed integral and bent over such as to form a stem installed in a bore formed in said handle end, an elastomeric sleeve being disposed in said bore such as to elastically and resiliently hold said stem in said bore.

15. The device of claim 14 further comprising at least one piercing member fixedly attached to said handle end.

16. The device of claim 14 further comprising a strap attached to the other end of said handle.

17. The device of claim 14 wherein said means retaining said tubular housing slidably over said handle end comprises a diametrically disposed pin through the wall of said housing, said pin extending through a transverse slot axially disposed in said handle.

18. The device of claim 17 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

19. The device of claim 14 wherein said means for retaining said tubular housing slidably over said handle end comprises a pair of radially disposed pins projecting internally of said tubular housing into longitudinal grooves formed peripherally in said handle.

20. The device of claim 19 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

21. The device of claim 14 wherein said means for retaining said tubular housing slidably over said handle end comprises a reduced diameter portion on said handle proximate said end, an internal annular groove formed in said tubular housing proximate the other end thereof, and a retainer spring ring disposed in said annular groove.

22. The device of claim 21 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

23. The device of claim 14 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

24. A hand held non-lethal personal defense device comprising an elongated handle, a pair of piercing prong members projecting from one end of said handle, a tubular housing slidably disposed over said end of said handle and displaceable from a first position sheathing said piercing members to a second position wherein said piercing members projecting from the end of said tubular housing, spring bias means urging said tubular housing to said first position, and means retaining said tubular housing slidably over said handle end, each of said piercing members comprising a shank, a sharp point on the end of said shank, a bulge on said shank proximate said sharp point, the shanks being formed integral and bent over such as to form a stem installed in a bore formed in said handle end, and a pin disposed transversely in said bore such as to hold said stem in said bore.

25. The device of claim 24 further comprising a strap attached to the other end of said handle.

26. The device of claim 24 wherein said means retaining said tubular housing slidably over said handle end comprises a diametrically disposed pin through the wall of said housing, said pin extending through a transverse slot axially disposed in said handle.

27. The device of claim 26 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

28. The device of claim 24 wherein said means for retaining said tubular housing slidably over said handle end comprises a pair of radially disposed pins projecting internally of said tubular housing into longitudinal grooves formed peripherally in said handle.

29. The device of claim 28 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

30. The device of claim 24 wherein said means for retaining said tubular housing slidably over said handle end comprises a reduced diameter portion on said handle proximate said end, an internal annular groove formed in said tubular housing proximate the other end thereof, and a retainer spring ring disposed in said annular groove.

31. The device of claim 30 wherein said spring bias means comprises a coil spring compressibly held between the end of said handle disposed within said tubular housing and a flange formed on the end of said tubular housing, said flange having an aperture therethrough enabling said piercing member to project from said tubular housing when said housing is displaced to said second position.

32. The device of claim 24 wherein said spring bias means comprises a coil spring compressibly held between the end of said handle disposed within said tubular housing and a flange formed on the end of said tubular housing, said flange having an aperture therethrough enabling said piercing members to project from said tubular housing when said housing is displaced to said second position.

* * * * *